US011391527B2

(12) United States Patent
Brenton et al.

(10) Patent No.: US 11,391,527 B2
(45) Date of Patent: Jul. 19, 2022

(54) MAGAZINE LIMIT BLOCK

(71) Applicant: K2 Sales Inc., Lapeer, MI (US)

(72) Inventors: Bartt James Brenton, Lansing, MI (US); Michael J King, Lapeer, MI (US)

(73) Assignee: K2 Sales Inc., Lapeer, MI (US)

( * ) Notice: Subject to any disclaimer, the term of this patent is extended or adjusted under 35 U.S.C. 154(b) by 0 days.

(21) Appl. No.: 16/919,384

(22) Filed: Jul. 2, 2020

(65) Prior Publication Data

US 2021/0080205 A1 Mar. 18, 2021

Related U.S. Application Data

(60) Provisional application No. 62/869,751, filed on Jul. 2, 2019.

(51) Int. Cl.
*F41A 9/71* (2006.01)
*F41A 9/70* (2006.01)

(52) U.S. Cl.
CPC . *F41A 9/70* (2013.01); *F41A 9/71* (2013.01)

(58) Field of Classification Search
CPC ..... F41A 9/71; F41A 9/70
USPC ..... 42/49.02
See application file for complete search history.

(56) References Cited

U.S. PATENT DOCUMENTS

D718,834 S * 12/2014 Mayberry ..... D22/108
9,328,982 B2 * 5/2016 Ladner ..... F41A 9/71
2012/0246988 A1 * 10/2012 Ladner ..... F41A 9/71 42/49.02
2013/0192115 A1 * 8/2013 Calilung ..... F41A 9/71 42/49.01

* cited by examiner

*Primary Examiner* — Reginald S Tillman, Jr.
(74) *Attorney, Agent, or Firm* — Loomis, Ewert, Parsley, Davis & Gotting P.C.

(57) ABSTRACT

A magazine limit block is provided having a base configured to fit within an interior of a magazine body and a tapered main body configured to guide and support a spring within an interior of a magazine body. The tapered main body extends upwardly from the base. A notch is formed at a top surface of the limit block and is configured to accommodate and provide space for a connection point of the spring and a follower. The main body is configured to occupy space within a magazine body to limit a number of rounds of ammunition that fit inside the magazine and guides the spring during cycling.

18 Claims, 13 Drawing Sheets

MAGAZINE LIMIT BLOCK

CROSS REFERENCE TO RELATED APPLICATION

This application claims priority to U.S. Provisional Application No. 62/869,751 filed Jul. 2, 2019, which is hereby incorporated herein by reference in its entirety.

TECHNICAL FIELD

The present disclosure relates generally to the field of hunting rifles and various systems for improved design and functionality.

DESCRIPTION OF RELATED ART

Firearms for hunting and sport use have historically both come from and inspired military-style rifles. Both share a common thread. Hunting, sport and military rifles share similar characteristics of ruggedness, accuracy and durability. The principle difference between todays hunting and sport rifles versus military rifles is the semi-automatic nature of the hunting and sport rifles versus the fully automatic nature of military rifles. A semi-automatic rifle is a rifle that fires one round for one pull of the trigger, while a fully-automatic rifle fires repeatedly until the trigger is released following the initial pull. Throughout history firearms have taken advantage of newer materials and technology and have incorporated them both into modern designs. Certain aesthetic, feel, and functionality is desired.

SUMMARY

The present disclosure provides for a rifle receiver lock alignment and tensioning system that includes a rear alignment lug defining a groove configured to receive an alignment and tension plunger pin, wherein the plunger pin includes a plunger button that positions into the groove when an upper receiver and a lower receiver are connected to form an assembled rifle. The plunger pin is positioned within a threaded body having threads on an outer surface to engage a receiving hole formed in the lower receiver and supported by a tension spring that is compressed upon engagement. The engagement of the plunger pin within the groove is adapted to form a tension fit and alignment of the rifle in an assembled configuration providing a tight fit and feel. This is effective in significantly reducing play and movement between the upper and lower receiver of the rifle. The tensioning system is configured to align upper and lower receivers to each other such that lateral play in a final assembly is reduced as compared to a rifle without this system. The tensioning system is configured to further maintain a uniform tension between upper and lower receiver such that vertical play in the final assembly is also reduced as compared to a rifle without this system.

The present disclosure further provides for a ring mount system—barrel nut and handguard alignment system that is configured to effectively align the receiver, barrel and handguard interface system. The ring mount system includes a barrel nut defining a plurality of annular keyway grooves formed on the outer surface of the barrel nut, a hand guard sized to receive the barrel nut within an opening of the handguard and defining a plurality of securing holes to lineup and physically engage the round keyway grooves of the barrel nut, a handguard keyway pin sized and shaped to pass through the securing hole and rest within the annular keyway groove of the barrel nut, and a fastener (like a screw) that engages the handguard keyway pin on each end of the handguard keyway pin on the outside of the handguard, thus preventing the handguard and the barrel nut from disengaging. The keyway pins also linearly align the handguard with respect to the barrel and the upper receiver. The ring mount allows for a universal exterior for precise barrel nut torque specifications. Precise perpendicularity between an internal seating ring of the barrel nut and an exterior surface of the barrel nut provides for accurate alignment of the handguard in relation to the barrel. The system further includes precision mount grooves to provide "rigid" mounting of the handguard and eliminate or substantially reduce longitudinal play.

The present disclosure further provides for a real feel handguard that can be molded or pultruded with a composite material. The composite handguard may include a polymer core for use in a rifle or other firearm technology. In this example, the handguard defines an annular cross section, which can be configured in a mold or pultrusion die to accommodate various design choices and geometries. In an example, the handguard is molded or pultruded rather than being wound. The handguard can include carbon and can be made with a plurality of layers including one or more interior fiberglass layers defining an interior opening, a relatively thick or multilayered polymer core formed around the interior fiberglass layers, and one or more exterior fiberglass layers formed around the polymer core. At least one of the interior or exterior fiberglass layers may include a carbon fiber layer that is at least partially formed therein to add reinforcement and other benefits. In an example, the handguard includes a pair of carbon layers positioned within the outer fiberglass layer and spaced apart evenly to form an upper carbon layer and a lower carbon layer, wherein the carbon layers partially extend circumferentially around within the outer fiberglass layers. The handguard can further include anti-rotational "ears" to eliminate or reduce rotational play of the handguard which results in precision alignment of the handguard to an upper receiver. It can further include precision mount holes.

In another example, the carbon layer extends entirely around the circumference of the handguard forming a uniform layer within the outer layer. In yet another example, the handguard is formed defining an interior barrel channel sized and shaped to receive a barrel of a rifle, one or more interior fiberglass layers forming the barrel channel, additional fiberglass layers, one or more exterior fiberglass layers formed annularly around the polymer core and having a pair of spaced apart partial carbon fiber reinforcement layers positioned within the one or more exterior fiberglass layers.

In yet another example, the handguard is free from any carbon layer. In still another example the handguard is free of polymer core. The handguard can be formed defining an interior barrel channel sized and shaped to receive a barrel of a rifle. The layers can be formed around the interior fiberglass layers and one or more exterior fiberglass layers are formed annularly around those layers.

An example process for forming the handguard includes starting with a bladder and/or mandrel, then layering a composite material which may or may not include carbon, around the bladder or mandrel to a desired thickness. Once the desired thickness is achieved, the layered material is encased in a mold that defines the desired exterior shape. The molding process includes a curing step followed by disassembling the mold and final machining of the resulting handguard. The bladder or mandrel is removed during the disassembling step following the curing step. When using a bladder, air is introduced into the bladder once the layered material and bladder are provided into the mold causing the bladder to expand. Pultrusion is another example process available for forming handguards according to the present disclosure.

The present disclosure further provides for a limit block round limiter and spring guide. The limit block is operable for limiting a number of rounds that fit into a magazine and which centers and guides a spring in compression and decompression cycles. The limit block is a removable unit having a base that rests against a bottom plate of a magazine body and extending from the base sized to fit within the spring of a magazine. The limit block limits round capacity and guides a spring during cycling. The base provides a relatively flat support that abuts an end of the spring and a main body of the limit block and is sized and shaped to support the spring as it compresses and decompresses. The main body of the limit block includes tapered sides that extend away from the base towards a follower. The tapered sides are configured to guide the spring for a more effective compression and decompression cycle as rounds are loaded into and/or discharged from the magazine. The main body of the limit block defines a thickness and width that is sufficient to center the spring to keep it from contacting the sides of the main body during cycling. A top portion of the main body forms a notch to provide clearance for a connection piece of the follower that connects to an end of the spring. The tapered sides of the block extend along a longitudinal axis defined by the sides of the magazine body but also to each other forming a smaller thickness at a top portion relative to a bottom portion. The block is rigid and thus serves as a physical limit to block the number rounds that can fit within the magazine body since the follower cannot drop below the height of the limiting block. The block can be formed from various materials and of various sizes depending on the desired round count. The block can be useful when limitations exist related to caliber of ammunition and number of rounds that can be carried within a magazine for a particular hunt, event, etc. The limit block further includes grooves at the base of the limit block to provide for alignment within the magazine body.

For purposes of summarizing the disclosure, certain aspects, advantages, and novel features of the disclosure have been described herein. It is to be understood that not necessarily all such advantages may be achieved in accordance with any one particular embodiment of the disclosure. Thus, the disclosure may be embodied or carried out in a manner that achieves or optimizes one advantage or group of advantages as taught herein without necessarily achieving other advantages as may be taught or suggested herein. The features of the disclosure which are believed to be novel are particularly pointed out and distinctly claimed in the concluding portion of the specification. These and other features, aspects, and advantages of the present disclosure will become better understood with reference to the following drawings and detailed description.

BRIEF DESCRIPTION OF THE DRAWINGS

The figures which accompany the written portion of this specification illustrate embodiments and method(s) of use for the present disclosure constructed and operative according to the teachings of the present disclosure.

The various embodiments of the present disclosure will hereinafter be described in conjunction with the appended drawings, wherein like designations denote like elements.

DETAILED DESCRIPTION

Figure 1A:
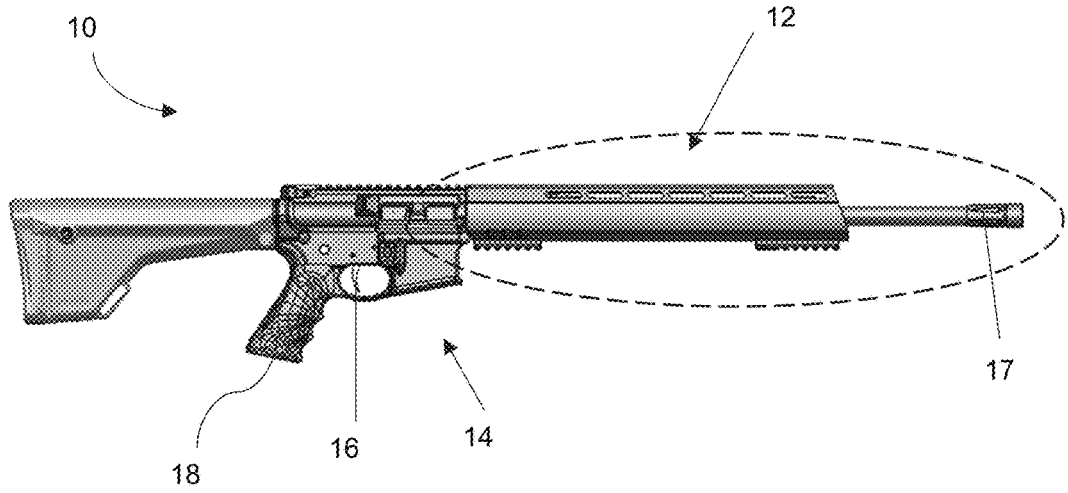
FIG. 1A shows an exemplary rifle according to the present disclosure fully assembled having a rifle receiver alignment system.
Figure 1B:
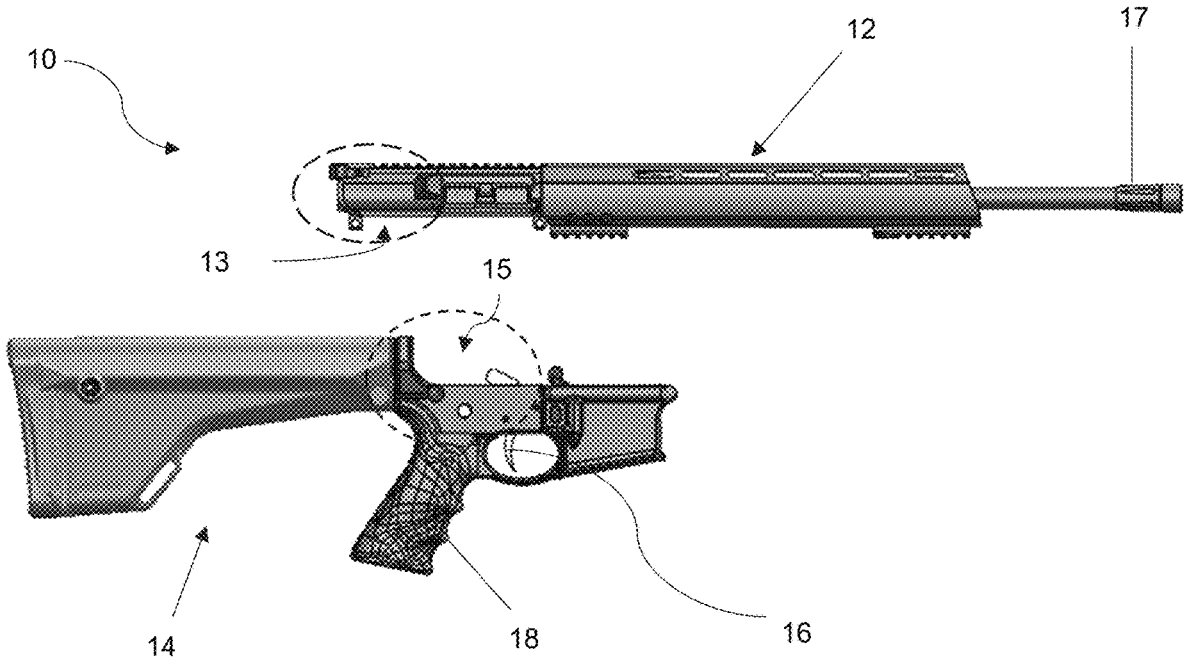
FIG. 1B shows the rifle of FIG. 1A disassembled with upper and lower sections disengaged.
Figure 1C:
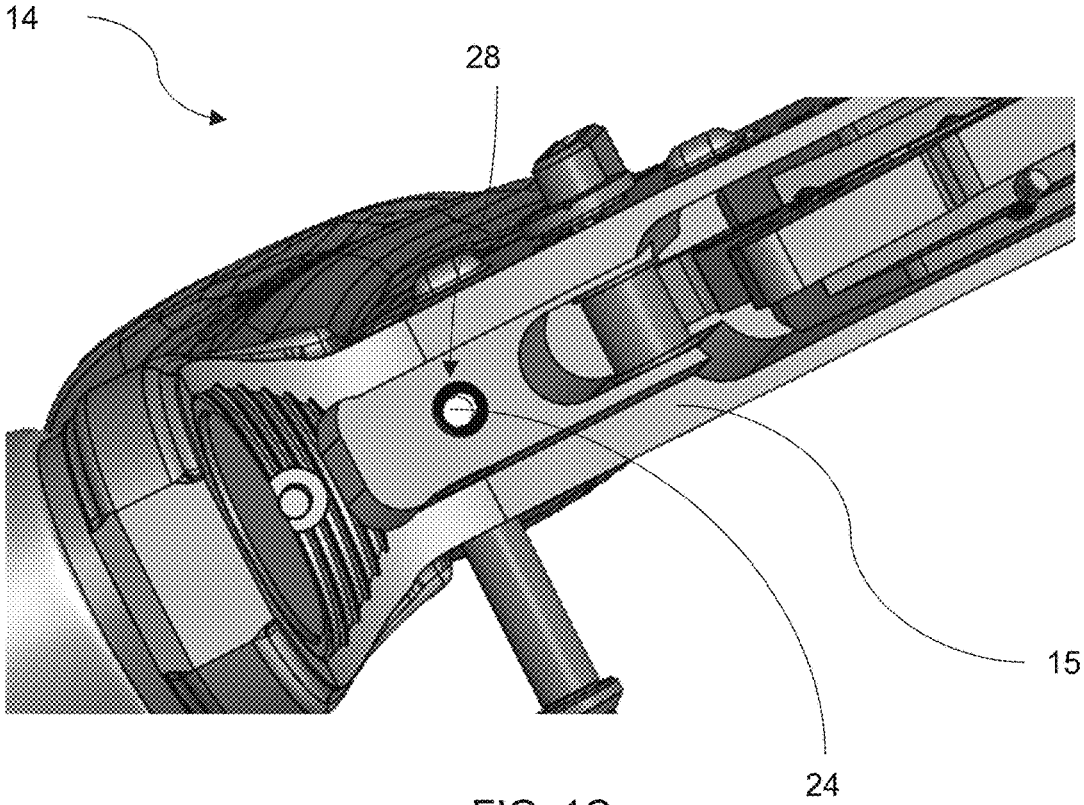
FIG. 1C shows an interior section of the lower section of the rifle of FIG. 1A with an alignment plunger within the lower section.
Figure 1D:
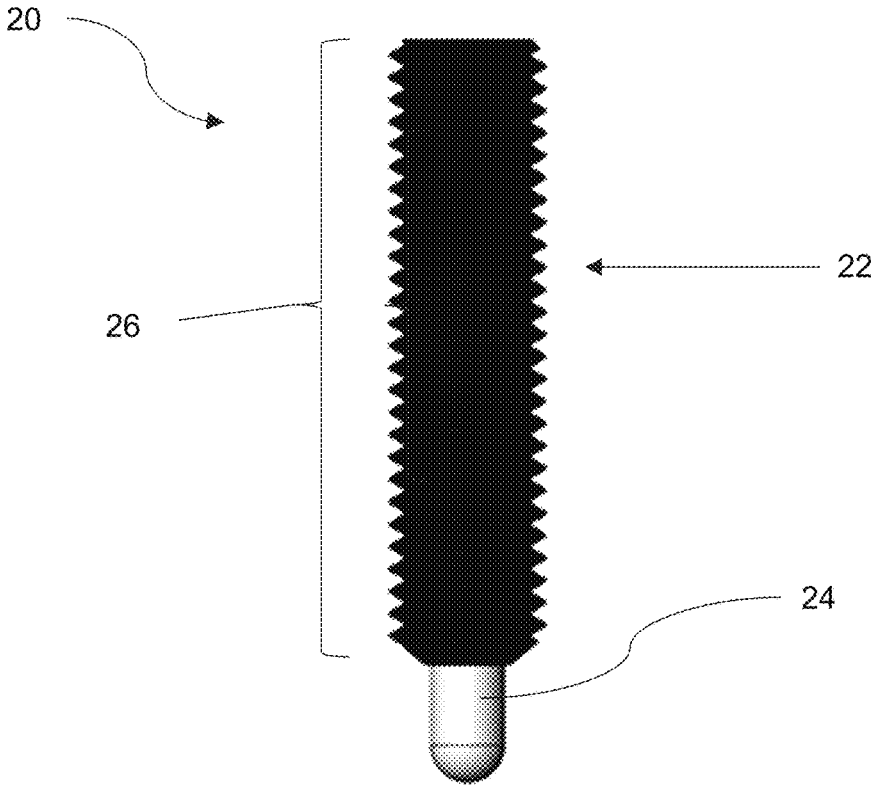
FIG. 1D shows a spring-loaded plunger of the alignment system of FIG. 1A.
Figure 1E:
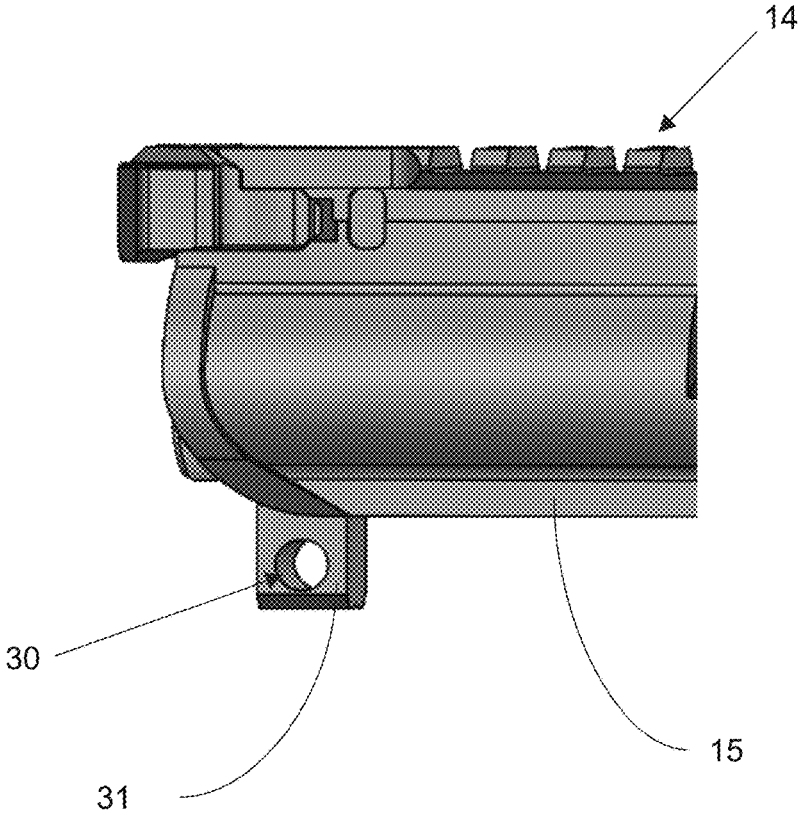
FIG. 1E shows a rear receiver lug of the upper section of the rifle of FIG. 1A.
Figure 1F:
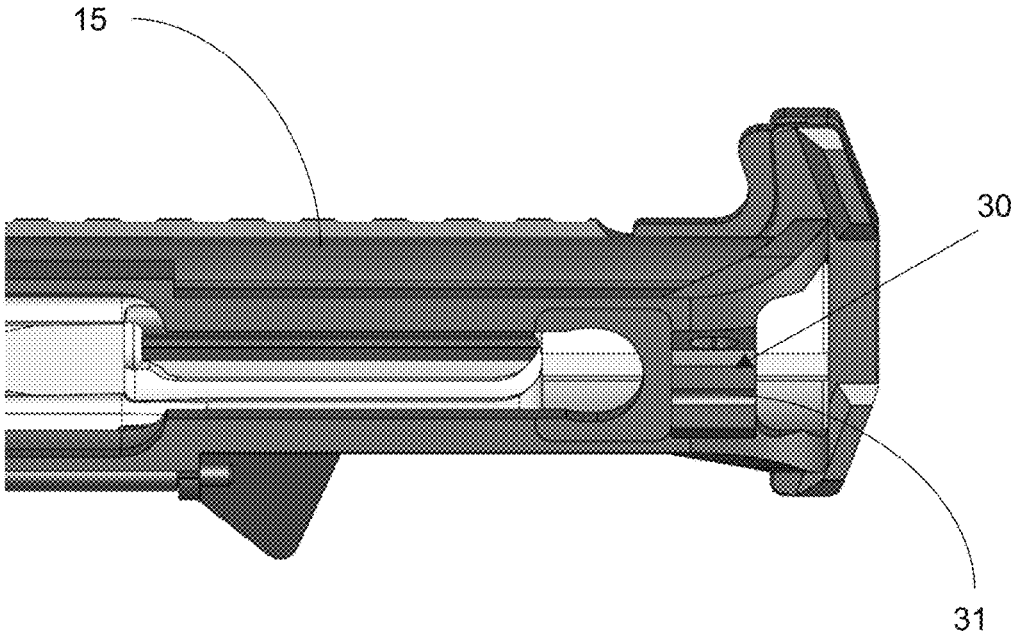
FIG. 1F shows an alignment groove formed on the upper section of the rifle of FIG. 1A for engaging the plunger.
Figure 2A:
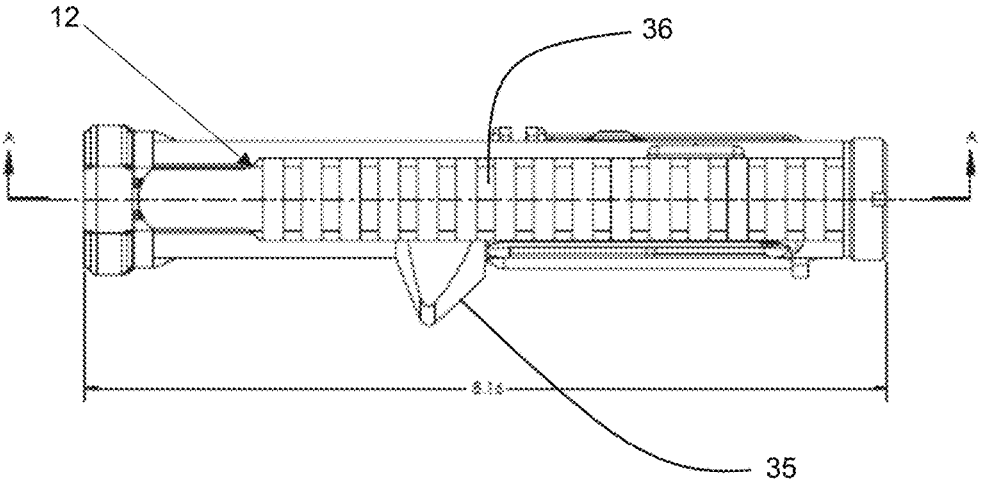
FIG. 2A is a top side schematic view illustration of a rifle having a rifle receiver alignment system according to the present disclosure.
Figure 2B:
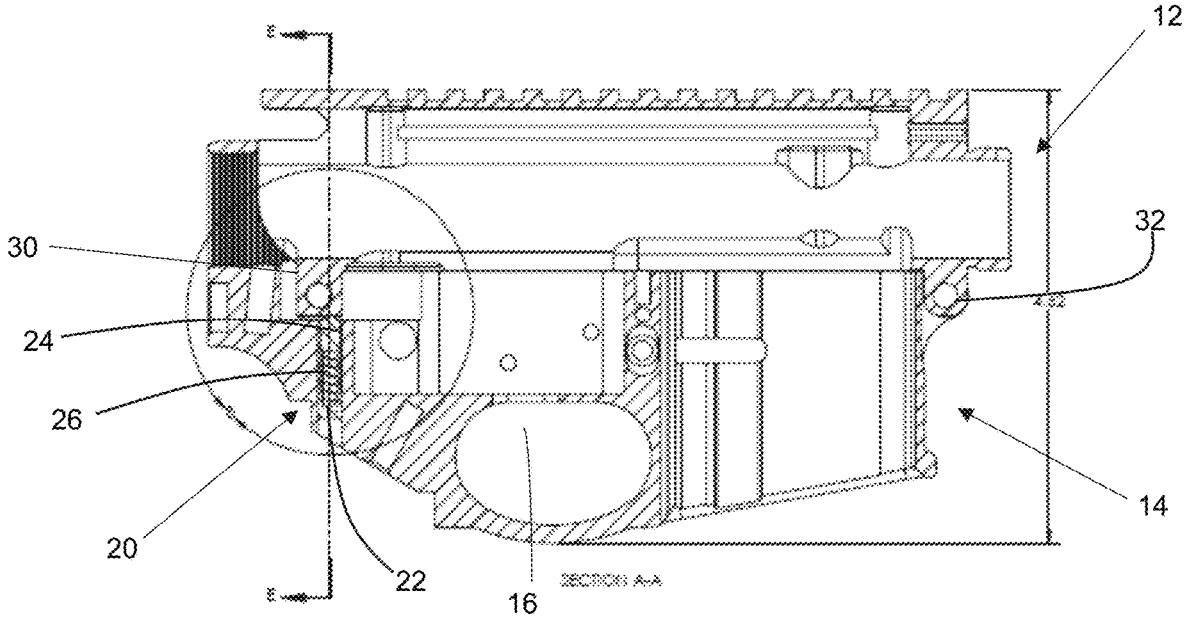
FIG. 2B illustrates a cross section view across A-A of FIG. 2A with the rifle receiver alignment system fully engaged.
Figure 2C:
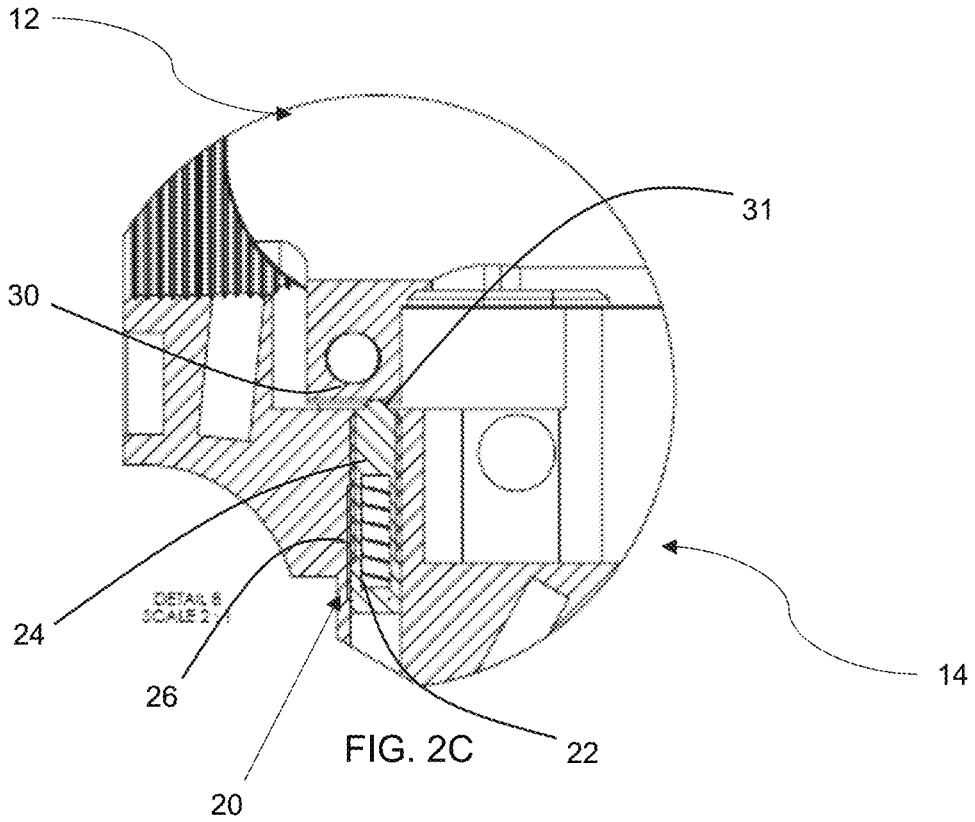
FIG. 2C illustrates a magnified view of detail B from FIG. 2B.
Figure 2D:
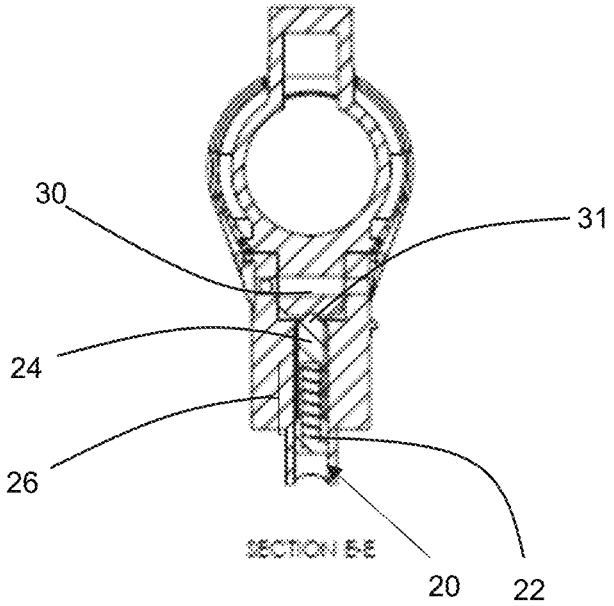
FIG. 2D illustrates a cross section view across E-E from FIG. 2B.
Figure 3A:
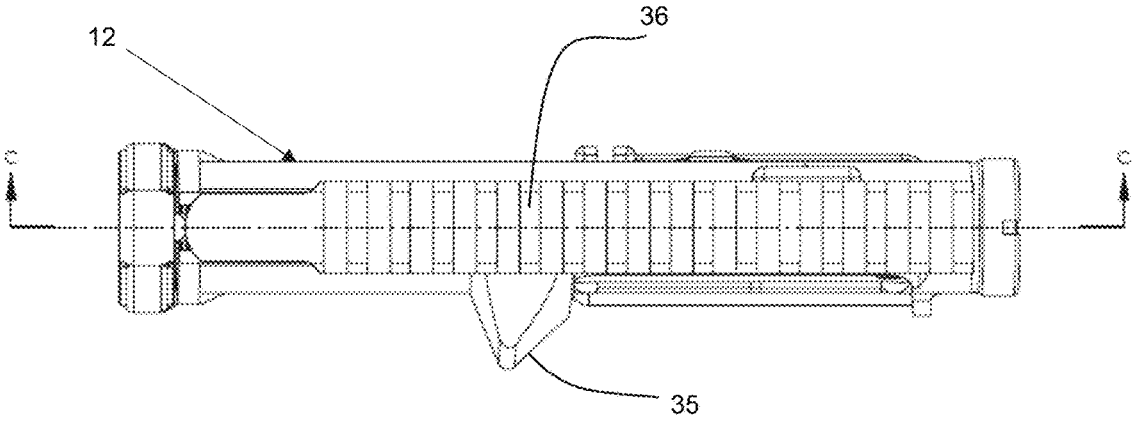
FIG. 3A is a top side schematic view illustration of a rifle having a rifle receiver alignment system according to the present disclosure.
Figure 3B:
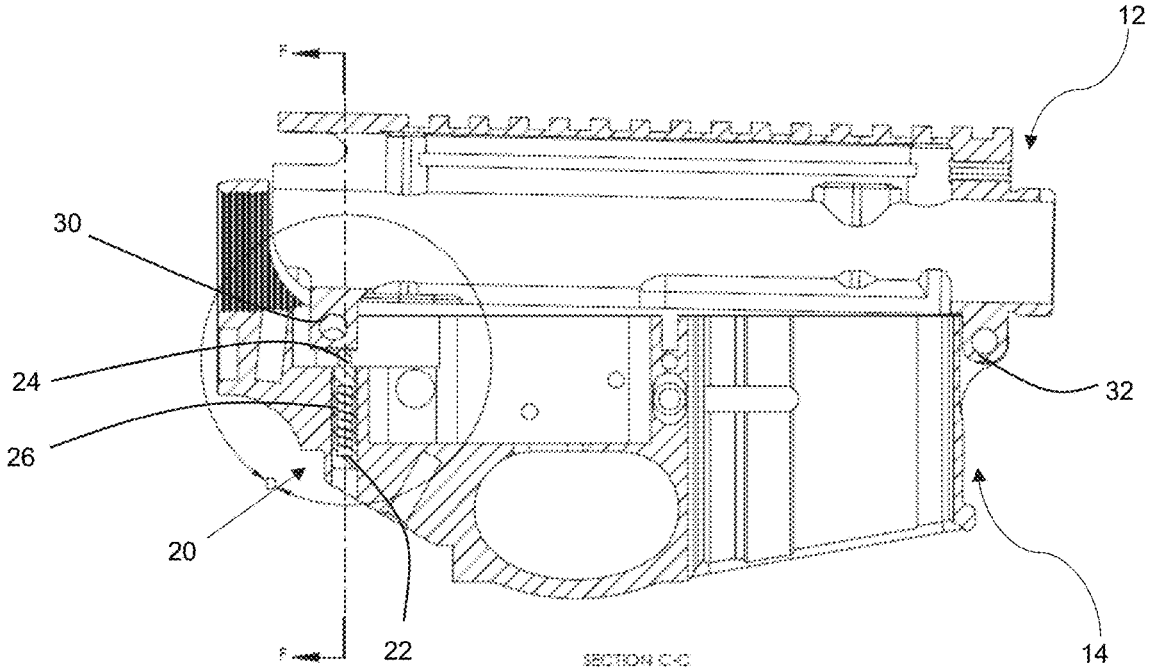
FIG. 3B illustrates a cross section view across C-C of FIG. 3A with the rifle receiver alignment system disengaged.
Figure 3C:
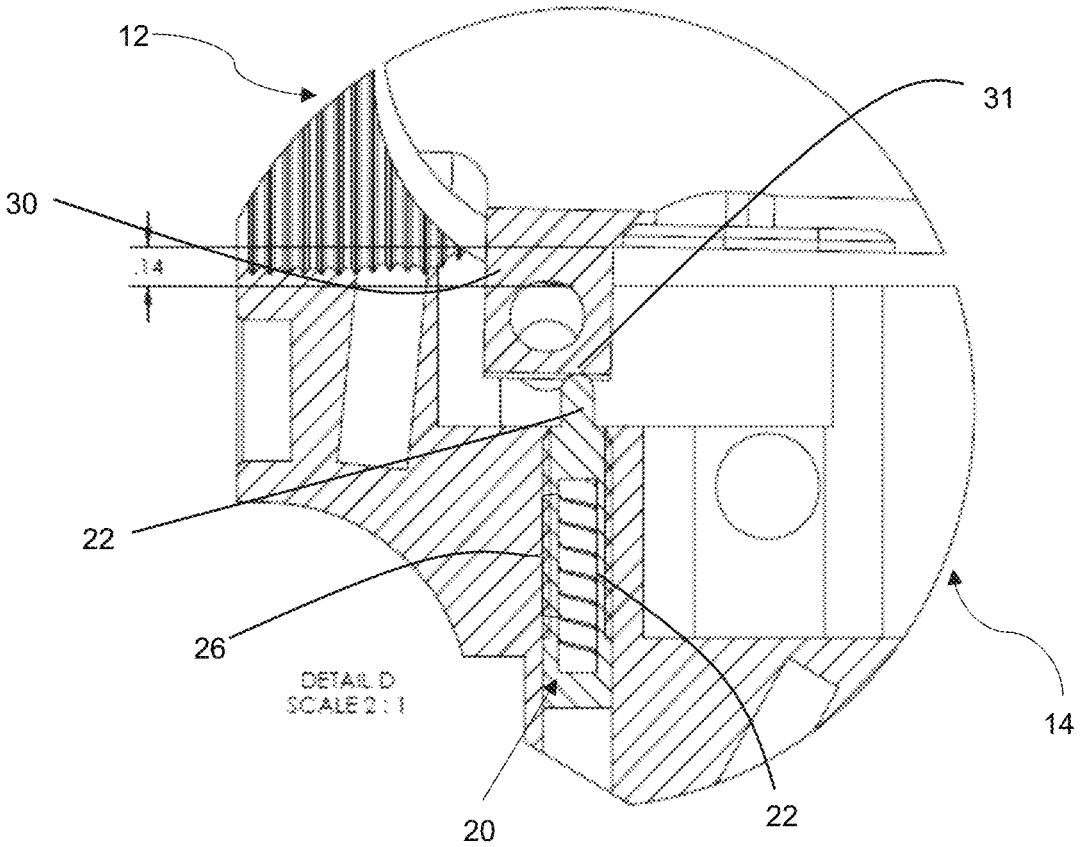
FIG. 3C illustrates a magnified view of detail D from FIG. 3B.
Figure 3D:
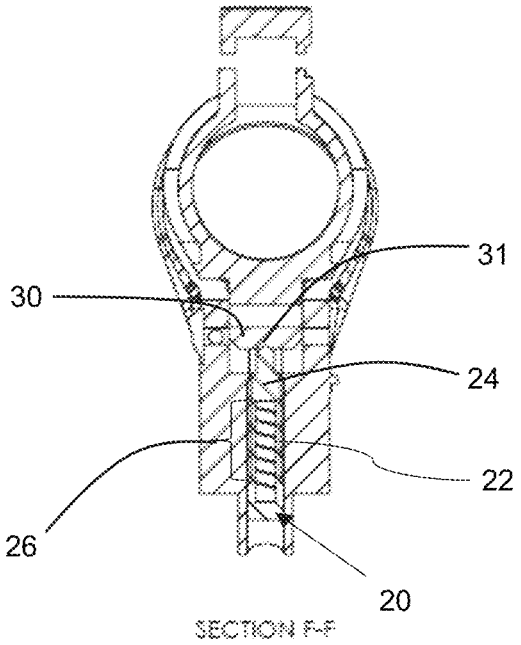
FIG. 3D illustrates a cross section view across F-F from FIG. 3B.

The present disclosure relates to a rifle receiver alignment and tension system; composite handguard and process of making; receiver, barrel and handguard interface system; and magazine limit block.

In an example, FIGS. 1A-3D are directed to a receiver lock tensioning system, also referred to as a rifle receiver alignment system showing an engaged and disengaged configuration. In this example, rifle 10 is a semi-automatic hunting rifle with an upper receiver 12 and lower receiver 14 (also referred to upper section 12 and lower section 14). Rifle 10 includes a grip 18 and a trigger 16, which when activated through pulling, sends a round of ammunition out through barrel 17. Upper receiver 12 can be disassembled from lower receiver 14. In order to assemble rifle 10, the exterior portion of upper receiver 13 is aligned with and pressed into the interior portion of lower receiver 15. The interior portion of lower receiver 14 defines a cavity shaped to receive upper receiver 12.

Receiver lock tensioning system 20 includes a plunger pin 22 that sits within threaded hole 28 of the lower receiver 15 and engages an alignment groove 31 of lug 30. System 20 is located at a connection point between upper receiver 12 and lower receiver 14 of rifle 10. The system creates tension between the two receiver halves while also providing aid in the alignment, which improves uniform tension between the upper and lower receiver and significantly reduces or eliminates lateral and vertical play in a final assembly. Unwanted movement is commonly referred to as "play", between the upper receiver and lower receiver.

System 20 includes plunger pin 22 which is configured with a body 26 that engages hole 28 in the lower receiver. In this example, hole 28 is threaded and receives corresponding threads defined on the plunger pin body 26. Plunger pin 22 further includes an interior tension spring and plunger button 24. Plunger button 24 is oriented towards the upper receiver 13. When fully assembled, plunger pin 22 engages with a bottom surface of rear lug 30 located towards a rear portion of upper receiver 12. Rear lug 30 defines an alignment groove 31, which is sized and shaped to receive and engage with plunger button 24. When upper receiver 12 and lower receiver 14 are connected, rear lug 30 aligns to receive plunger pin 22. Plunger button 24 fits within alignment groove 31 and thus, the interior tension spring creates force and tension between the upper and lower receiver so as to substantially reduce and/or eliminate movement between the upper and lower receiver, also known as lateral or vertical play in a final assembly.

FIGS. 2A-2D show the alignment and tension system 20 in the engaged position. Plunger button 24 is positioned within alignment groove 31 so that plunger button 24 is fixed in a compressed position. This engaged position secures upper receiver 12 to lower receiver 14.

FIGS. 3A-3D show the system 20 in the disengaged position so that plunger button 24 is fully extended and not compressed in a disengaged position. When in the disengaged position, upper receiver 12 is not fully secured/engaged to lower receiver 14 at the rear portion of upper receiver 12. In order to place the receivers in the engaged position, the user would need to properly align rear lug 30 with plunger pin 22 and exert sufficient force on the upper receiver so as to engage plunger button 24 into alignment groove 31. The engagement of plunger pin 22 with rear lug 30 is adapted to form a secure fit, providing a tight feel of a rifle 10 and significantly reducing play and movement between the upper and lower receiver of the rifle.

Previously, rifles comprised of an upper and lower receiver in an assembled configuration would result in unwanted lateral and vertical play. Forming a tight fit that reduced or eliminated movement and play was not achievable.

FIGS. 4A-4D illustrate a ring mount system, also referred to as receiver, barrel, and handguard interface system 40. In this example, a plurality of fasteners 48 interact with a barrel nut 44 and a handguard 42. They system 40 is put in place to secure handguard 42 to a barrel of a rifle. The connection is made in such a way as to substantially reduce and/or prevent any linear or rotational movement of the handguard 42, also commonly referred to as "play". In this example, round keyway pins 46 fit through apertures 53 defined on each side of the handguard 42. Round keyway pins 46 are then rested against and within annular keyway grooves 49 defined on the barrel nut 44. The round keyway pins 46 tightly secure the handguard 42 to the barrel nut 44 in a linear orientation on a barrel 17. In this example, a universal exterior is provided that allows for precise barrel nut torque specifications. Precise perpendicularity between an internal seating ring of the barrel nut and an exterior surface of the barrel nut provide for accurate alignment of handguard in relation to barrel. The precision mount grooves provide "rigid" mounting of the handguard and can eliminate or substantially reduce longitudinal play.

Previously, fasteners were used to squeeze the handguard in place while aligning and engaging with the barrel nut itself, however, the alignment pins were never used to rest against the barrel nut itself. In the present disclosure, the round keyway pins 46 engage with the annular keyway grooves 49 formed on the barrel nut 44 so as to exert pressure and maintain the orientation of the handguard 42 and the barrel nut 44 as well as securely hold the pieces in place.

Ring mount system 40 securely fastens and aligns a handguard 42 to a barrel 17 of an upper receiver of a rifle. Handguard 42 and barrel nut 44 are aligned concentrically where the barrel nut 44 fits inside the handguard 32. Apertures 53, located on both the left and right inferior side of handguard 42, are aligned with annular keyway grooves 49 defined on barrel nut 44. In an example, the annular grooves are spaced 0.600" apart from one another.

Handguard 42 and barrel nut 44 are aligned with respect to each other by interface system 45, which includes round keyway pins 46 that enter through aperture 53 and engage annular keyway grooves 49 so as to tightly hold barrel nut 44 and handguard 42 together. In this example, three round keyway pins 46 pass through three apertures 53 and rest in 3 separate annular keyway grooves 49. A barrel 17 passes through a barrel cavity 50 defined by the barrel nut 44. Interface system 45 includes one or more fastener round keyway pins 46, an optional washer 47, and end fasteners 48. Fastener 48, in this example, is a screw that enters washer 47 and a threaded opening formed on an interior of round keyway pin 46. The screws 48 are fashioned to engage fastener round keyway pin 46 on each end and on the outside of apertures 53 thus holding round keyway pins 46 in place. Apertures 53 are sized and shaped to form a cavity to receive the head of the screw 48 and hold round keyway pins 46 in place against the annular keyway grooves 49. This also provides a substantially flush appearance without an undesired flange or other form that extends away from the natural contour of the handguard body.

In an example, additional fasteners (i.e., screws in this example) are used to affix rails 51 to a bottom of handguard 42 so that additional rifle accessories can be used with the rifle, including bipods or tripods commonly used to steady, control and improve the accuracy of the rifle.

Figure 4A:
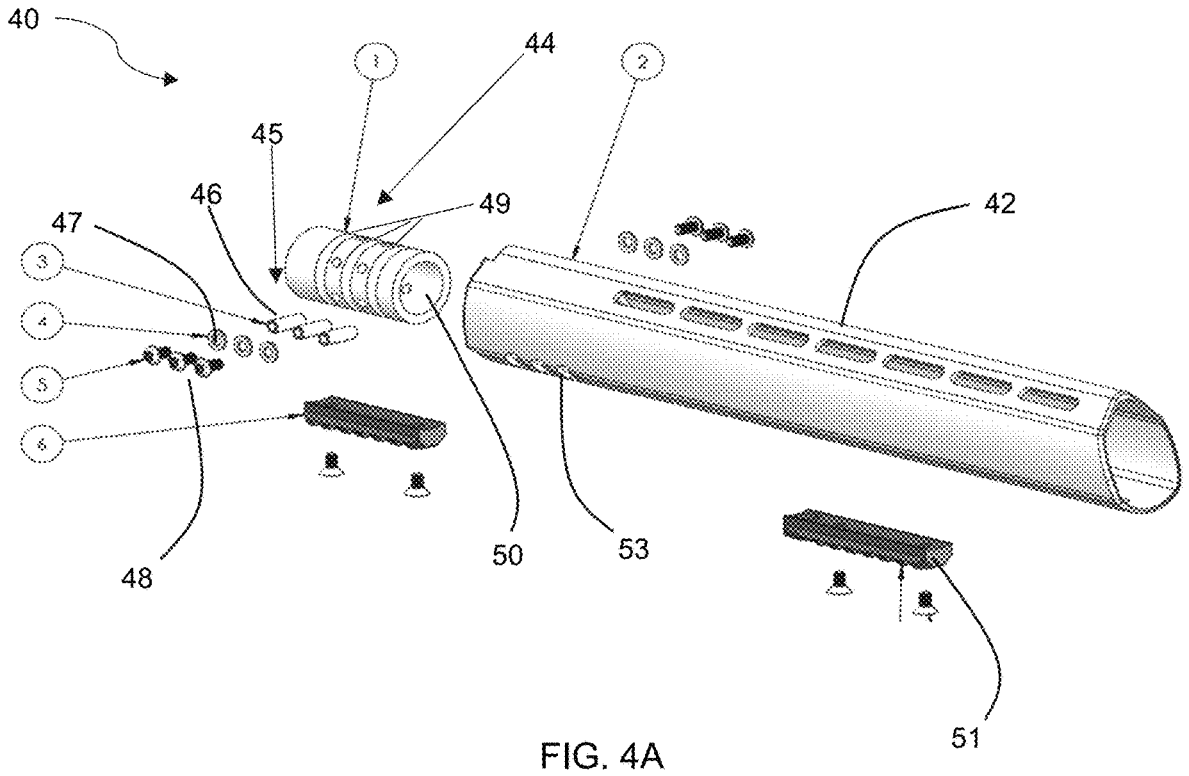
FIG. 4A illustrates an exemplary handguard, barrel nut and handguard interface system in an exploded view
Figure 4B:
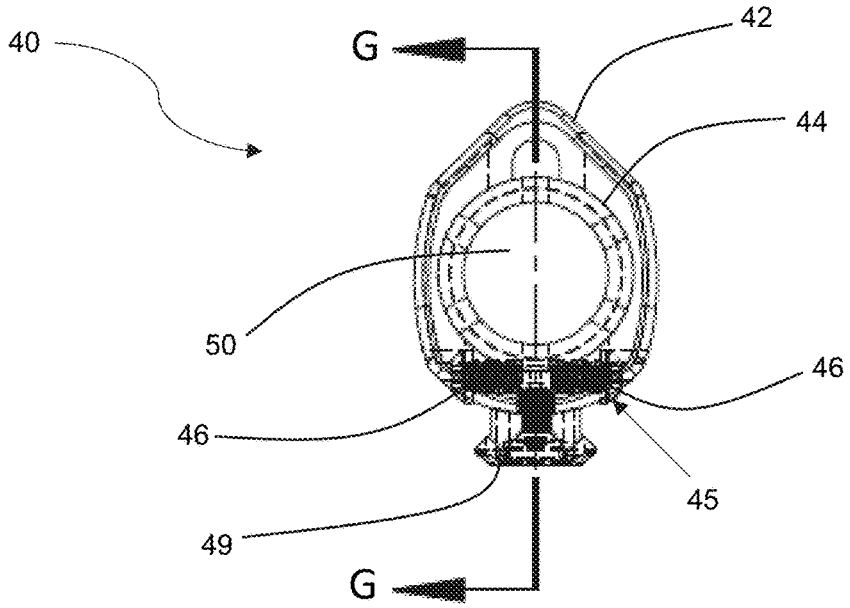
FIG. 4B illustrates a front face schematic view of the handguard of FIG. 4A.
Figure 4C:
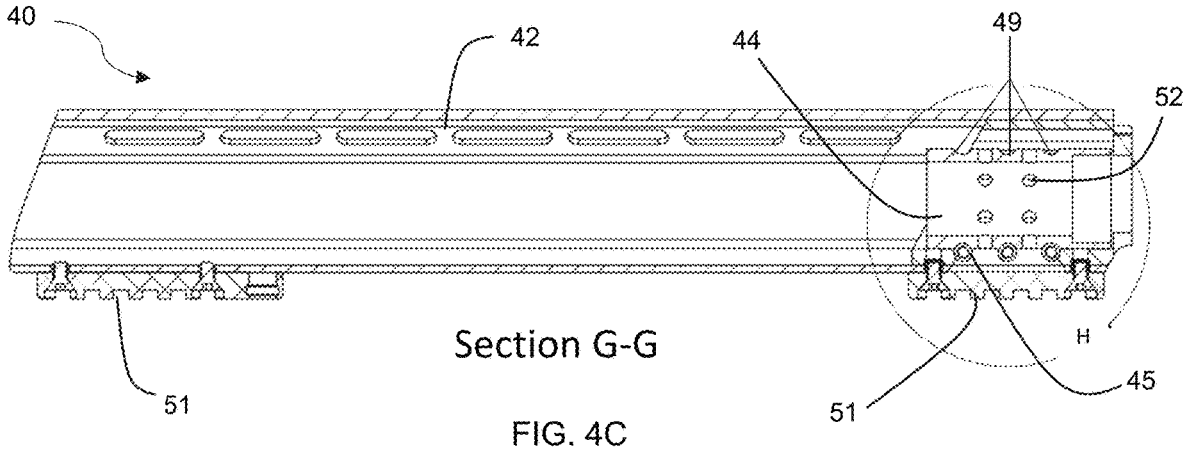
FIG. 4C illustrates a cross section view across G-G from FIG. 4B.
Figure 4D:
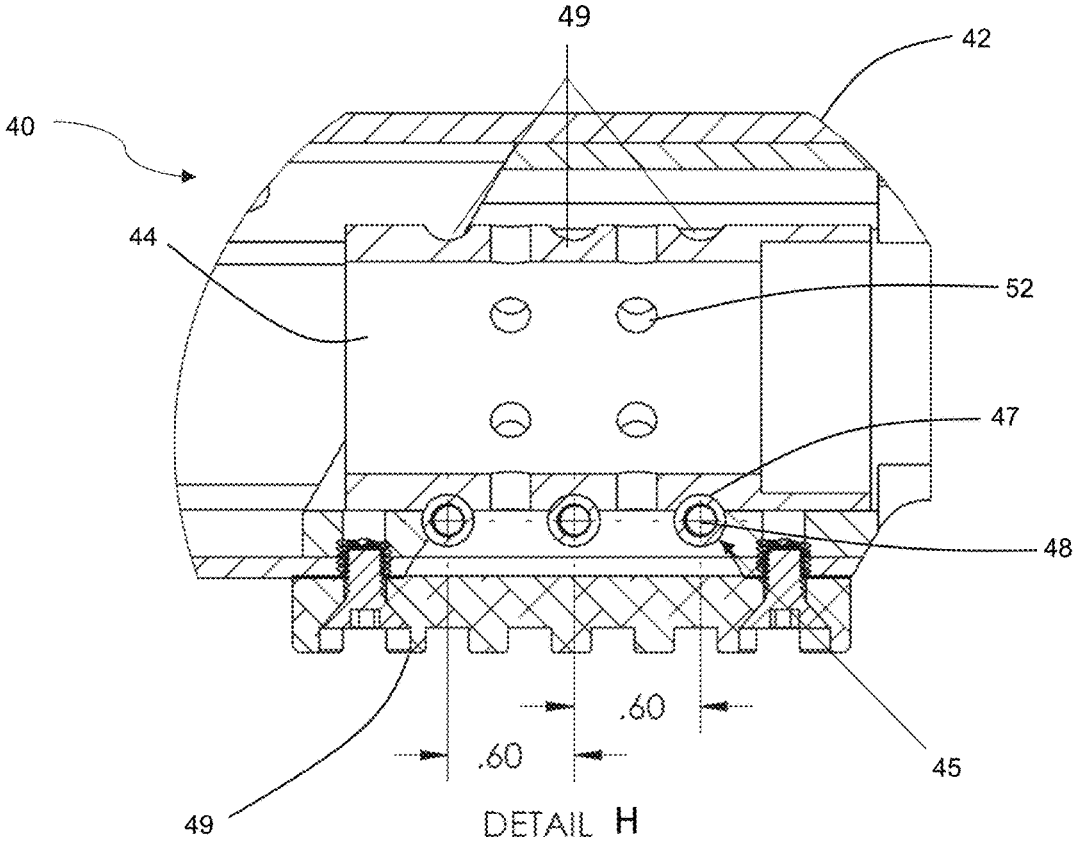
FIG. 4D illustrates a magnified view of the detail H from FIG. 4C.

FIG. 4B shows a cross-section view of ring mount system 40 whereby barrel nut 44 and handguard 42 are aligned concentrically to form an interior barrel cavity 50. Interface system 45 is engaged on both the right and left bottom portion of the handguard 42 showing round keyway pins 46 on both sides of handguard 42. FIGS. 4C-4D show a longitudinal cross-section of system 40 with interface system 45 engaged with annular keyway grooves 49. In an example, wrench holes 52 are located on barrel nut 44 so as to allow for tightening of the barrel nut 44.

Forming a handguard of a molded composite material allows for freedom to form a handguard of various designs, shapes, thicknesses, etc. as desired. In an example the handguard includes carbon. In a further example, the handguard includes fiberglass and in yet another example, the handguard includes both layers of carbon and layers of fiberglass. Carbon allows for the handguard to maintain and achieve desired strength, stability, feel, and light-weight characteristics. This can be achieved through any molding technique including layering materials on a bladder or mandrel followed by molding and curing and/or pultruding a layered material.

Figure 5:
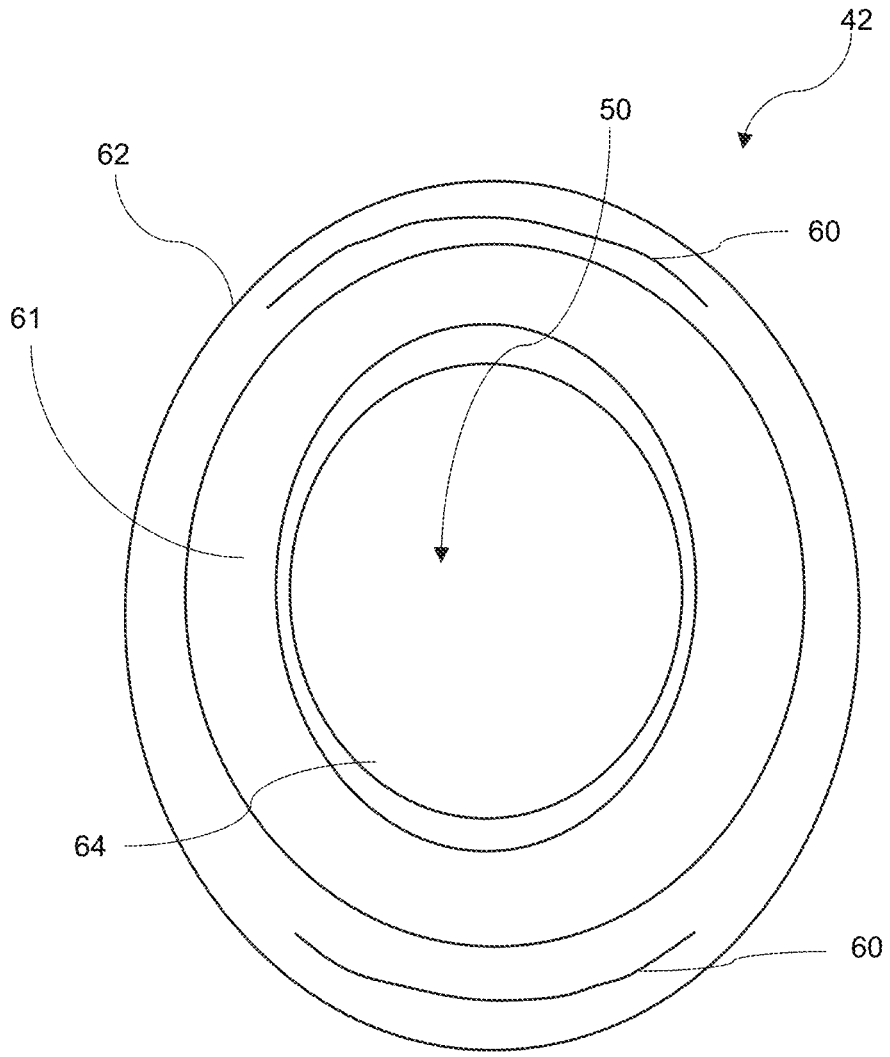
FIG. 5 illustrates a schematic cross section illustration of a composite handguard having a carbon polymer core according to the present disclosure.

FIG. 5 is directed to a schematic cross section view of a real feel composite handguard 42 having a polymer core 61 according to the present disclosure. The handguard 42 can be a substantially tubular construction molded to a profile and includes multiple layers of fiberglass and a polymer core. In this example, one or more exterior layers of fiberglass 62 are provided to surround a polymer core 61 having a desired thickness. The polymer core 61 can be layered or fabricated to a predetermined thickness forming an annular geometry surrounding one or more interior fiberglass layers. In another example, one to ten exterior layers of fiberglass are provided. In yet another example, two to five layers are provided. Polymer core 61 surrounds one or more interior layers of fiberglass 64. In an example, one to ten interior layers are fiberglass are provided. In yet another example, two to five layers are provided.

In the example of FIG. 5, at least one reinforcement carbon fiber layer 60 is provided within the exterior layers of fiberglass 62. In an example, the carbon fiber layers 60 are strategically positioned within the fiberglass layers 64 to provide reinforcement to the overall handguard 42 and additional support and rigidity to the handguard 42.

The reinforcement carbon fiber layers 60 can be positioned throughout the exterior fiberglass layers 64 at various circumferential positions or all the way around throughout the fiberglass layer 64. In this example, the carbon fiber layers 60 are positioned spaced apart evenly with respect to each other so as to form an upper carbon layer and a lower carbon layer. This can provide the structural reinforcement at specific desired areas of the handguard. In another example, the carbon fiber layers 60 can be positioned so that they are spaced apart to form side carbon fiber layers 60 (not shown). Additionally, the carbon fiber layers can be positioned annularly so as to form a carbon layer ring (not shown).

Previous handguards are typically fabricated from a single layer of metal, such as aluminum. This results in a handguard having high thermal conductivity, causing the handguard to get extremely hot in warm conditions or extremely cold in cold conditions. The multilayer handguard of the present disclosure reduces the thermal conductivity of the handguard by forty (40) times while maintaining or exceeding structural strength and durability as well as providing an alternative look and feel. This provides for less fluctuation in temperate of the handguard, allowing for direct contact with the handguard and improved overall functionality of the rifle over a broader surrounding temperature range. Carbon fiber can be five to ten times stronger than aluminum and up to about three times stronger than steel. Inserting carbon fiber layers into the fiberglass layers provides for additional strength in the handguard that prevents breakage or loss of structural integrity and shape. The multilayer handguard of the present disclosure further offers advantages over one made solely from carbon fiber, in that carbon fiber can be expensive. Inserting carbon fiber layers into fiberglass provides for a cost-efficient and effective handguard.

Referring to FIGS. 6-8B, magazine limit block 80 is shown for use with a magazine 70 to limit rounds of ammunition (not shown). A magazine 70 is shown for holding one or more rounds of ammunition. The magazine 70 includes a magazine body 71 defining an interior cavity having an interior perimeter, a follower 72 for holding rounds of ammunition of a desired size and caliber, a spring 73 and a base plate 75. The follower 72 is configured to slide up and down within the magazine body 71. The spring 73 is configured to engage the follower 72 and applies force upward as rounds of ammunition are discharged or emptied. In this example, spring 73 is a compression spring that rests against the base plate 75 and connects to a bottom portion of the follower 72. As rounds of ammunition are loaded into the magazine body and against the follower 72, the spring 73 is compressed and thus applying a force up against follower 72. This causes the follower 72 to move upward, releasing the compression in the spring 73, as rounds of ammunition are discharged.

A limit block 80 is provided to be inserted into the magazine 70 and configured to fill space within the interior magazine cavity to reduce or prevent (e.g., limit) the number of rounds that can fit within the magazine 70. Limit block 80 is positioned within an internal channel formed by spring 73 and abuts and/or rests against bottom plate 75 within the magazine body 71. Limit block 80 defines one or more alignment grooves 182 formed on a base 82 and shaped accommodate and conform to an interior perimeter of the magazine 70. Thus, limit block 80 can fit securely within an interior cavity of magazine 70. In this example, base 82 defines an overall rectangular geometry that matches a cross section geometry of the interior perimeter of the magazine body 71. The magazine body 71 defines a width W and a thickness T, wherein the W is substantially larger than T. Accordingly, a desired caliber of bullet (ammunition), which is typically elongated, securely fits within the magazine body 71. The base 82 of limit block 80 is configured to fit within these dimensions having a width $W_B$ and a thickness of $T_B$, wherein the $W_B$ is substantially larger than $T_B$ and $W>W_B$ and $T>T_B$.

The limit block 80 provides a structural block to fill the space within housing 71 and thus reduces the number of rounds of ammunition that can be stored within the magazine 70. According to certain laws and regulations relating to hunting, hunters can only use certain types of firearms and ammunition and numbers of rounds to hunt certain types of animals. It can become burdensome to use a specific type of magazine that holds the required number of rounds based on a certain hunting season. A limit block 80 can be placed in the magazine 70 to limit the number of rounds that can be held and thus comply with varying regulations.

Figure 6:
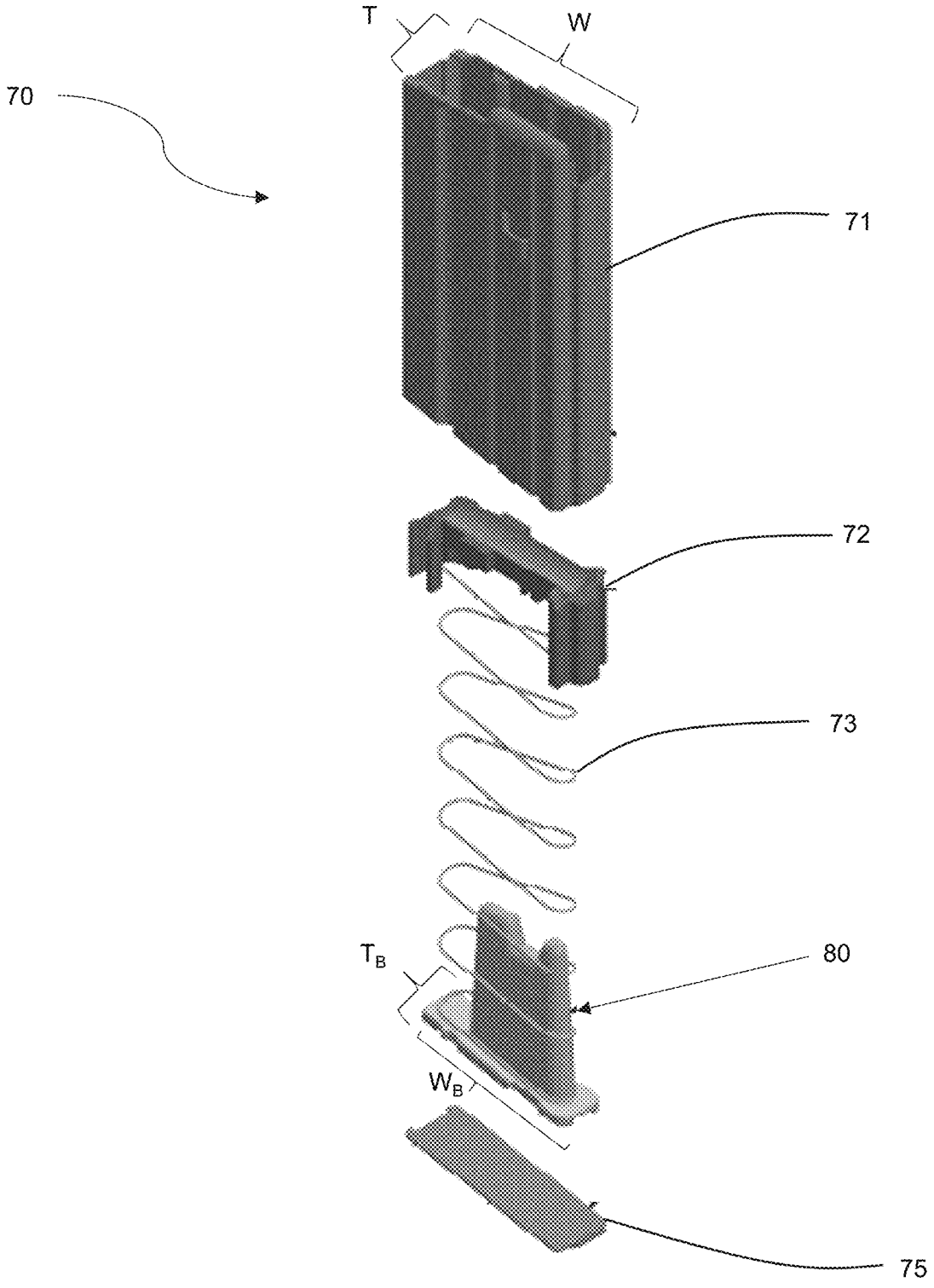
FIG. 6 illustrates an exploded view of a magazine including a limit block and spring alignment according to the present disclosure.

FIG. 6 shows an exploded view of limit block 80 which includes magazine body 71 that houses follower 72, spring 73, limit block 80 and bottom plate 75. One end of spring 73 connects to a bottom of follower 72, while an opposite end surrounds and engages with the base 82 of limit block 80. The follower 72, spring 73, and limit block 80 are configured to fit directly into the magazine body 71 and held in place by bottom plate 75. Grooves 182 formed on base 82 of limit block 80 are shaped to align within an interior perimeter of the magazine 70.

FIGS. 7A-8B show profile and perspective views of limit block 80. Limit block 80 includes a base 82, a main body 81, and defines a notch 84. Notch 84 is configured to create a space to accommodate the follower 72 and a connection point for the spring 73. Main body 81 is configured with tapered sides 85. The tapered sides 85 allow for a smoother flow of spring 73 when the spring compresses and decompresses as rounds of ammunition are cycled. The main body 81 is configured to be a structural support guide for spring 73 to ensure desired movement and guiding of the follower 72 during cycling.

Prior attempts to restrict magazine volume do not have a defined cone shape which allows the spring to move freely, unguided and unsupported within the magazine body, which can lead to malfunctioning and misfeeding of the rounds. Main body 81 defines a width $W_L$ at or near base 82 and a thickness $T_L$. The tapered sides 85 gradually extend towards each other forming a smaller upper width $W_{L-x}$ and thickness $T_{L-x}$ as compared to the width $W_L$ and thickness $T_L$. This forms a substantially truncated "cone" shape that centers and guides spring 73 which enhances the movement of follower 72. Thus, the limit block 80 provides for smooth movement of the spring 73 since the tapering substantially follows the natural movement of the spring while maintaining structural support through its thickness and prevents the spring from undesired collapsing.

Figure 7A:
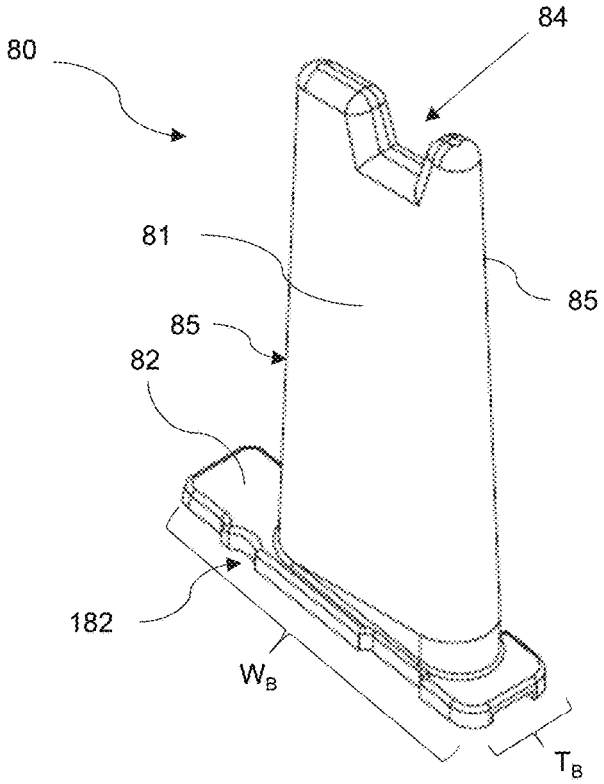
FIG. 7A shows a perspective schematic view of a limit block according to the present disclosure.
Figure 7B:
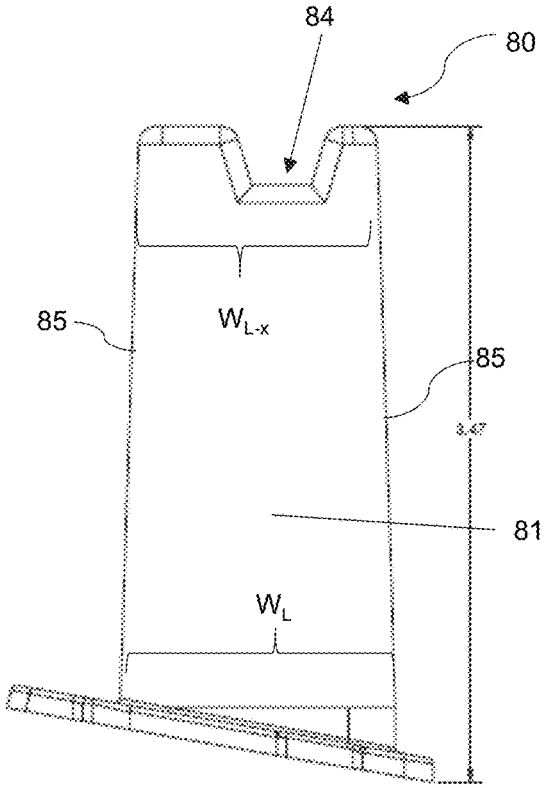
FIG. 7B illustrates a schematic side view of the limit block of FIG. 7A.
Figure 7C:
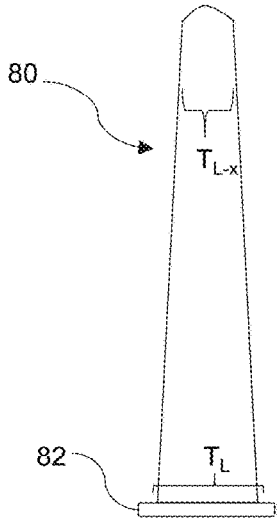
FIG. 7C illustrates a schematic front face view of the limit block of FIG. 7A.
Figure 8A:
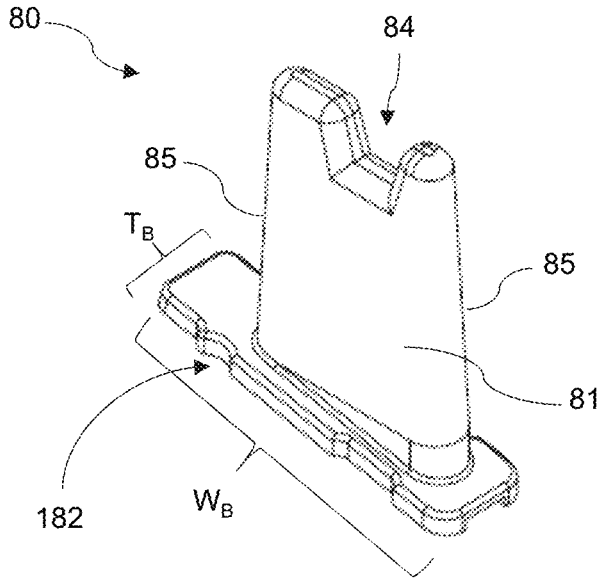
FIG. 8A shows a perspective schematic view of a smaller limit block as compared to the limit block of FIG. 7A.
Figure 8B:
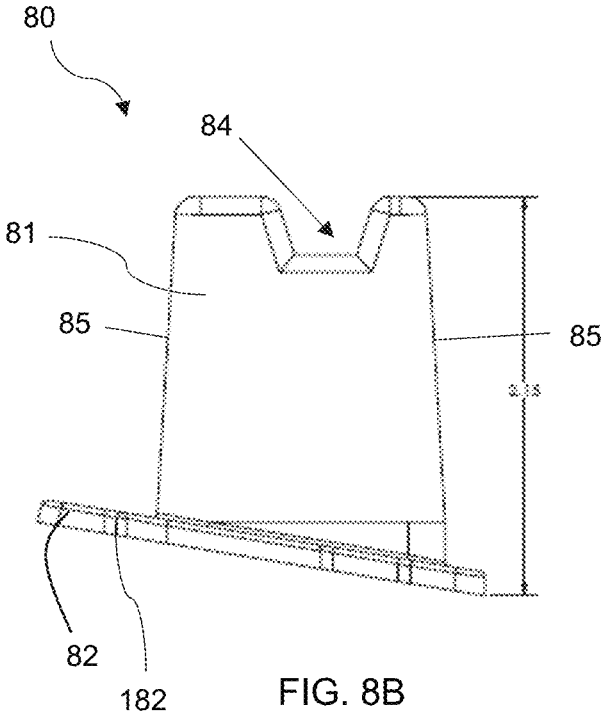
FIG. 8B illustrates a schematic side view of the limit block of FIG. 8A.

Limit block 80 can define various lengths depending on the desired round count and caliber of ammunition. In one embodiment, limit block 80 defines a length of 3.47" as shown in FIGS. 7A-7B. In another embodiment, limit block 80 defines a length of 2.15". In another example, a limit block can be made having tapered support ribs. The support ribs allow for reduced material volume of the main body while maintaining strength and support of the overall limit block. The limit block can be made through most any molding processes of various sizes for a desired fit for a magazine.

It should be noted that the steps described in the method of use can be carried out in many different orders according to user preference. The use of "step of" should not be interpreted as "step for", in the claims herein and is not intended to invoke the provisions of 35 U.S.C. § 112 (f). Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

What is claimed is:

1. A magazine limit block comprising:

(a) a base configured to fit within an interior of a magazine body;

(b) a tapered main body configured to guide and support a spring within an interior of a magazine body, the tapered main body extending upwardly from the base; and (c) a notch formed at a top surface of the limit block configured to accommodate and provide space for a connection point of the spring and a follower;

wherein the tapered main body is configured to (i) occupy space within a magazine body to limit a number of rounds of ammunition that fit inside the magazine, and (ii) guide the spring during cycling;

wherein the tapered main body defines a width and a thickness at the base, the tapered main body having tapering sides that extend away from the base and towards each other having a gradually reducing width and thickness as it progresses upwardly toward the follower forming a smaller upper width and thickness as compared to the width and thickness defined at the base; and wherein the tapered main body defines a truncated cone shape configured to center and guide the spring to provide for smooth movement of the spring while maintaining structural support through its thickness and prevents the spring from undesired collapsing.

2. The magazine limit block of claim 1, wherein the limit block is removable.

3. The magazine limit block of claim 1, wherein the base is relatively flat and configured to abut and rest against a base plate of the magazine body.

4. The magazine limit block of claim 1, wherein the base defines one or more alignment grooves configured to accommodate and conform to an interior perimeter of the magazine body, wherein the limit block fits completely within the magazine body.

5. The magazine limit block of claim 1, wherein the tapered main body is configured to fit within an interior channel formed by the spring.

6. The magazine limit block of claim 1, wherein the tapered main body fits entirely within the spring and supports the spring at the base.

7. The magazine limit block of claim 1, wherein the tapered main body is configured to center the spring and prevent the spring from undesired collapsing as it compresses and decompresses within the magazine body.

8. The magazine limit block of claim 1, wherein the tapered main body defines a length of 3.47 inches.

9. The magazine limit block of claim 1, wherein the tapered main body defines a length of 2.15 inches.

10. A magazine limit block system having a magazine for a rifle and a removable limit block comprising:

(a) a magazine body having an interior cavity for receiving rounds of ammunition;

(b) a follower having a receiving surface configured to receive a round of ammunition and the follower configured to slide up and down within the magazine cavity during ammunition loading and discharge;

(c) a compression spring connected to a bottom connection point of the follower, the spring configured to compress as ammunition is loaded and apply upward pressure causing the follower to slide upwardly as ammunition is discharged;

(d) a bottom plate to secure the inner cavity of the magazine body;

(e) a limit block having a tapered main body configured to guide and support the spring within the interior of the magazine body, the tapered main body extending upwardly from a base; and (f) a notch formed at a top surface of the limit block configured to provide space for a connection point of the spring and the follower;

wherein the main body is configured to (i) occupy space within the magazine body to limit a number of rounds of ammunition that fit inside the magazine, and (ii) guide the spring during cycling;

wherein the tapered main body defines a width and a thickness at the base, the tapered main body having tapering sides that extend away from the base and towards each other having a gradually reducing width and thickness as it progresses upwardly toward the follower forming a smaller upper width and thickness as compared to the width and thickness defined at the base; and wherein the tapered main body defines a truncated cone shape configured to center and guide the spring to provide for smooth movement of the spring while maintaining structural support through its thickness and prevents the spring from undesired collapsing.

11. The magazine limit block system of claim 10, wherein the limit block is removable.

12. The magazine limit block system of claim 10, wherein the base is relatively flat and configured to abut and rest against a base plate of the magazine body.

13. The magazine limit block system of claim 10, wherein the base defines one or more alignment grooves configured to accommodate and conform to an interior perimeter of the magazine body, wherein the limit block fits completely within the magazine body.

14. The magazine limit block system of claim 10, wherein the tapered main body is configured to fit within an interior channel formed by the spring.

15. The magazine limit block system of claim 10, wherein the tapered main body fits entirely within the spring and supports the spring at the base.

16. The magazine limit block system of claim 10, wherein the tapered main body is configured to center the spring and prevent the spring from undesired collapsing as it compresses and decompresses within the magazine body.

17. The magazine limit block system of claim 10, wherein the tapered main body defines a length of 3.47 inches.

18. The magazine limit block system of claim 10, wherein the tapered main body defines a length of 2.15 inches.

* * * * *